US006105167A

United States Patent [19]

Wong

[11] Patent Number: 6,105,167

[45] Date of Patent: Aug. 22, 2000

[54] BUOYANCY AID

[76] Inventor: Man Kwan Wong, 1701 World Commerce Centre, Harbour City, 11 Canton Road, Kowloon, The Hong Kong Special Administrative Region of the People's Republic of China

[21] Appl. No.: 09/274,656

[22] Filed: Mar. 23, 1999

[30] Foreign Application Priority Data

Jun. 15, 1998 [GB] United Kingdom ..... 9812722

[51] Int. Cl.[7] ..... A42B 1/12

[52] U.S. Cl. ..... 2/68; 441/200.2; 441/209.11; 441/DIG. 3; 441/124

[58] Field of Search ..... 2/68, 200.2, 209.11, 2/DIG. 3, DIG. 10; 441/9, 30, 88, 124

[56] References Cited

U.S. PATENT DOCUMENTS

| | | | |
|---|---|---|---|
| 1,919,032 | 7/1933 | Neulander | 2/68 |
| 3,978,527 | 9/1976 | Bednar | 2/68 |
| 5,095,545 | 3/1992 | Lane | 2/68 |

FOREIGN PATENT DOCUMENTS

| | | | |
|---|---|---|---|
| 0 686 356 A1 | 12/1995 | European Pat. Off. | A42B 1/12 |
| 28 48 066 | 11/1979 | Germany | B63C 9/16 |
| 276236 | 8/1927 | United Kingdom . | |
| 882880 | 11/1961 | United Kingdom . | |
| 970991 | 9/1964 | United Kingdom . | |
| 1 488 592 | 10/1977 | United Kingdom | A42B 1/06 |

*Primary Examiner*—John J. Calvert
*Assistant Examiner*—Katherine Moran
*Attorney, Agent, or Firm*—Renner, Kenner, Greive, Bobak, Taylor & Weber

[57] ABSTRACT

A buoyancy aid wearable as a swimming cap in its uninflated condition and usable as a buoyancy aid in an inflated condition including a cap defining means configurable in its to be worn condition preferably to have one part thereof within another part thereof, the cap defining means including at least one inflatable chamber. An inflation unit is preferably carried by the cap defining means and is actuable to inflate the inflatable chamber(s). The outcome upon actuation of the inflation unit will be or is, should the inflated condition be achieved, that the inflatable chamber(s) configures (configure) the cap defining means to a form no longer wearable as a cap and with the one part no longer within the another part. The cap defining means when in its fully inflated form preferably has a configuration that is substantially that of an unshelled peanut therefor, with a waisted region. The inflation unit preferably uses a gas reservoir capable of releasing gas under pressure.

15 Claims, 7 Drawing Sheets

BUOYANCY AID

TECHNICAL FIELD

The present invention relates to a buoyancy aid in the guise of an inflatable swimming cap and to its use.

BACKGROUND ART

Some swimming or bathing caps capable of inflation have been proposed to ensure a more watertight fit or, in some cases, to provide buoyancy for a wearer's head when the wearer is floating on their back.

Br 276236 discloses a bathing cap having a life preserving function provided by the use of a retainable inflatable band which preferably also has the effect upon inflation of better fitting the wearer's head. Br 970991 discloses a bathing cap having pockets of air provided within the material of the cap or being of a kind fitted on an inside wall with inflatable tubes. Particular emphasis is placed on fit for comfort (eg; to exclude seawater from a swimmer's head). Br 882880 discloses a travelling cap for the purpose of cushioning a traveller's head (eg; much in the same way as a pillow). It relies on an inflatable sac or inflatable sacs.

Br 1488592 and U.S. Pat. No. 3,978,527 disclose an inflatable cap for swimmers amongst others which relies on at least one valved inflatable compartment defined, for example, by a suitably modified double walled cap of rubber or of a soft elastic plastics film.

EP 0 686 356 A1 discloses a swimming cap having an inflatable chamber on its outside. U.S. Pat. No. 5,095,545 discloses (over prior art of U.S. Pat. Nos. 3,403,406, 3,394, 406, 3,259,912, 3,321,772 and 3,480,967) a swimming cap with discrete pneumatic chambers captured between layers of an associated swim cap, the matrix of interconnected pneumatic chambers to index through openings of an inner wall of the swim cap.

DE 284066A discloses swimming or bathing caps subdivided into a number of inflatable chambers and adapted to provide emergency flotation. The chambers have valves enabling pressure sensitive inflation from a replaceable and releasably mounted pressured gas vessel.

DISCLOSURE OF THE INVENTION

The present invention is directed to a buoyancy aid wearable as a swimming or bathing headwear item (hereafter "swimming cap") which offers an alternative to any of the foregoing prior art arrangements whilst providing (at least when not fully inflated) a wearable cap capable of inflation for emergency buoyancy purposes when a need arises.

In accordance with a first aspect of the present invention, a buoyancy aid is wearable as a swimming cap in its uninflated condition and is usable as a buoyancy aid in an inflated condition. The buoyancy aid includes a cap defining means configurable in its to be worn condition to have one part thereof within another part thereof, the cap defining means including at least one inflatable chamber. An inflation unit is carried by the cap defining means and is actuable to inflate the inflatable chamber(s). The outcome upon actuation of the inflation unit will be or is, should the inflated condition be achieved, that the inflatable chamber(s) configures (configure) the cap defining means to a form no longer wearable as a cap and with the one part no longer within the another part.

Preferably the cap defining means when in its fully inflated form has a configuration that is substantially that of an unshelled peanut and the one part is that part of such substantial unshelled peanut form on one side of the waisted region thereof and the other part thereof is the part on the other side of the waisted region thereof.

Preferably the inflation unit includes a reservoir containing a gas under pressure capable upon actuation of the inflation unit of releasing gas to inflate the chamber(s). The inflation unit is preferably actuable by a manual activation of a triggering mechanism, and the cap defining means is preferably of a resilient material selected from rubber or an elastomer.

In accordance with a further aspect of the present invention, the buoyancy aid may be used as a swimming cap and includes a cap defining means configurable and worn with one part thereof within another part thereof, the cap defining means including an inflatable chamber. An inflation unit is carried by the cap defining means and is actuable to inflate the inflatable chamber. The outcome upon actuation of the inflation unit will be, should full inflation be achieved, that the inflatable chamber configures the structure to a form no longer wearable as a cap and with the one part no longer within the another part, the inflated form having a configuration substantially that of an unshelled peanut and the one part is that part of such substantially unshelled peanut form on one side of the waisted region of such substantially unshelled peanut form and the other part thereof is the part on the other side of the waisted region thereof. The unit also includes a gas under pressure capable upon actuation of the inflation unit of releasing gas into the inflatable chamber to inflate the chamber.

Preferably the cap defining structure, when in its fully inflated form, has a configuration substantially that of an unshelled peanut and the one part is that part of such substantial unshelled peanut form on one side of the waisted region thereof and the other part thereof is the part on the other side of the waisted region thereof.

In a further aspect the present invention includes an inflatable life-cap having an envelope which can be inflated to form a buoyant body, the envelope having first and second portions arranged so that, when the envelope is uninflated, the first portion is at least in part within the second portion to form a double layered swimming cap and means are provided whereby the envelope can be inflated to provide a buoyancy aid not wearable as a swimming cap in such inflated condition.

In still a further aspect the present invention, a buoyancy aid wearable as a swimming cap in its uninflated condition and usable as a deployable buoyancy aid in an inflated condition includes a cap defining means including at least one inflatable chamber, and inflation allowing means to allow inflation of the inflatable chamber(s).

Upon inflation, using the inflation allowing means, the inflatable chamber(s) configures (configure) the cap defining means to a form not still wearable as a cap in the same way during swimming as when uninflated yet providing a gas filled deployable buoyancy aid capable of displacing at least a volume of water at least as great as a volume of water the cap defining means covered head regions of a wearer would displace.

Preferably the inflation allowing means forms part of an inflation unit, and the inflation unit is carried by the cap defining means and is actuable to inflate the inflatable chamber(s) with gas to be sourced from a reservoir containing a gas under pressure. The reservoir containing a gas under pressure is preferably operatively associated as part of the inflation means, and the cap defining means when in its fully inflated form preferably has a configuration that is substantially that of a waisted unshelled peanut and one part of such substantial unshelled peanut form on one side of the waisted region thereof in the uninflated condition is insertable in the part on the other side of the waisted region thereof.

As used herein the term "inflatable chamber" includes any chamber which is defined irrespective of whether or not the walls thereof stretch in any way as a result of inflation, ie; includes even a form that simply reconfigures to a larger (ie; inflated) volume. Reference to "envelope" capable of inflation has a corresponding meaning.

As used herein "inflation allowing means" may form part of or be the inflation unit. Alternatively it may be a valved connection to some inflation device not itself carried by the cap defining means.

BRIEF DESCRIPTION OF THE DRAWINGS

A preferred form of the present invention will now be described with reference to the accompanying drawings in which.

PREFERRED EMBODIMENTS FOR CARRYING OUT THE INVENTION

Figure 7:
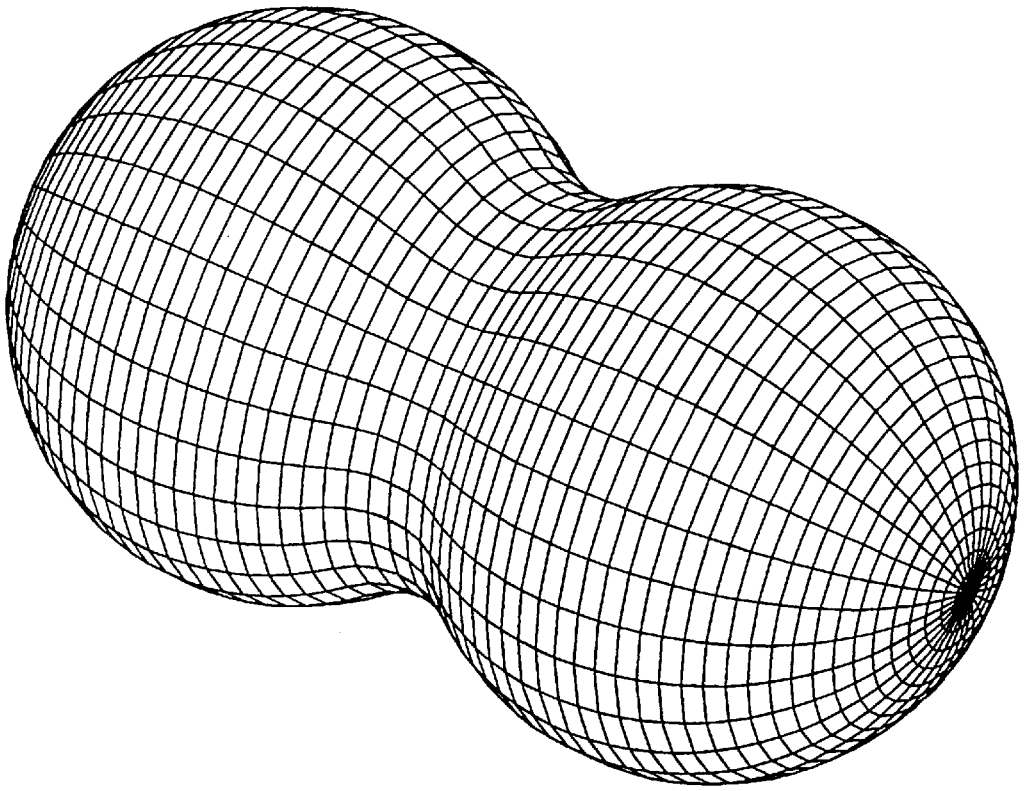
FIG. 7 shows the inflated buoyancy device as useful as a buoyancy aid and no longer in a form with one part within another which is wearable as a swimming cap but which nevertheless upon deflation can be returned to its original form.

In the preferred form of the present invention the inflated cap defining means takes a form of substantially an unshelled peanut substantially as shown in FIG. 7, the waisting of which serves both a purpose when it is in its swimming cap mode with one part within another part (ie; securement to a wearers head and some degree of waterproofing) and in its inflated form (as a means to locate the crook of a swimmer's arm).

Figure 1:
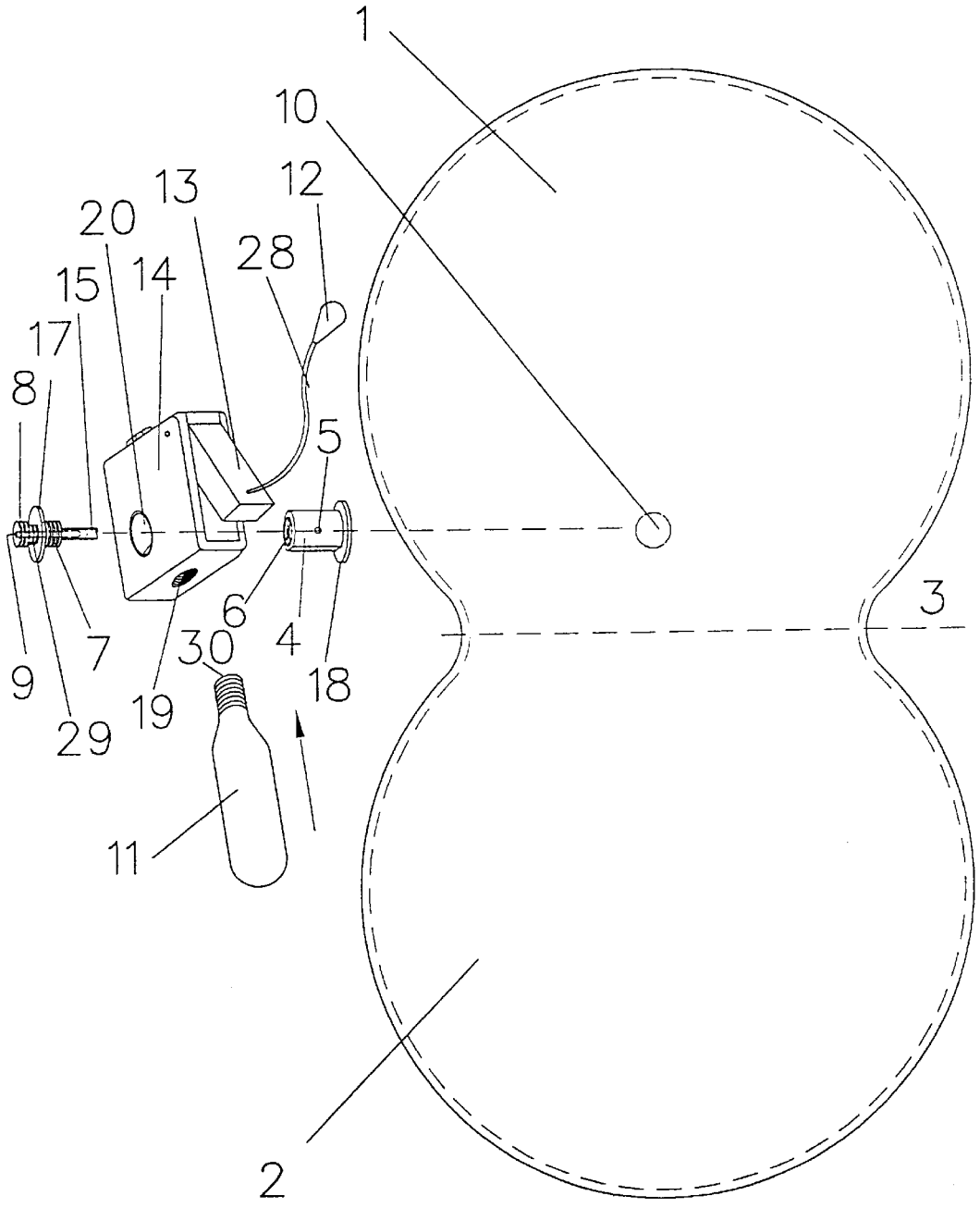
FIG. 1 shows in a disassembled form and in perspective a buoyancy aid in accordance with the present invention.
Figure 2:
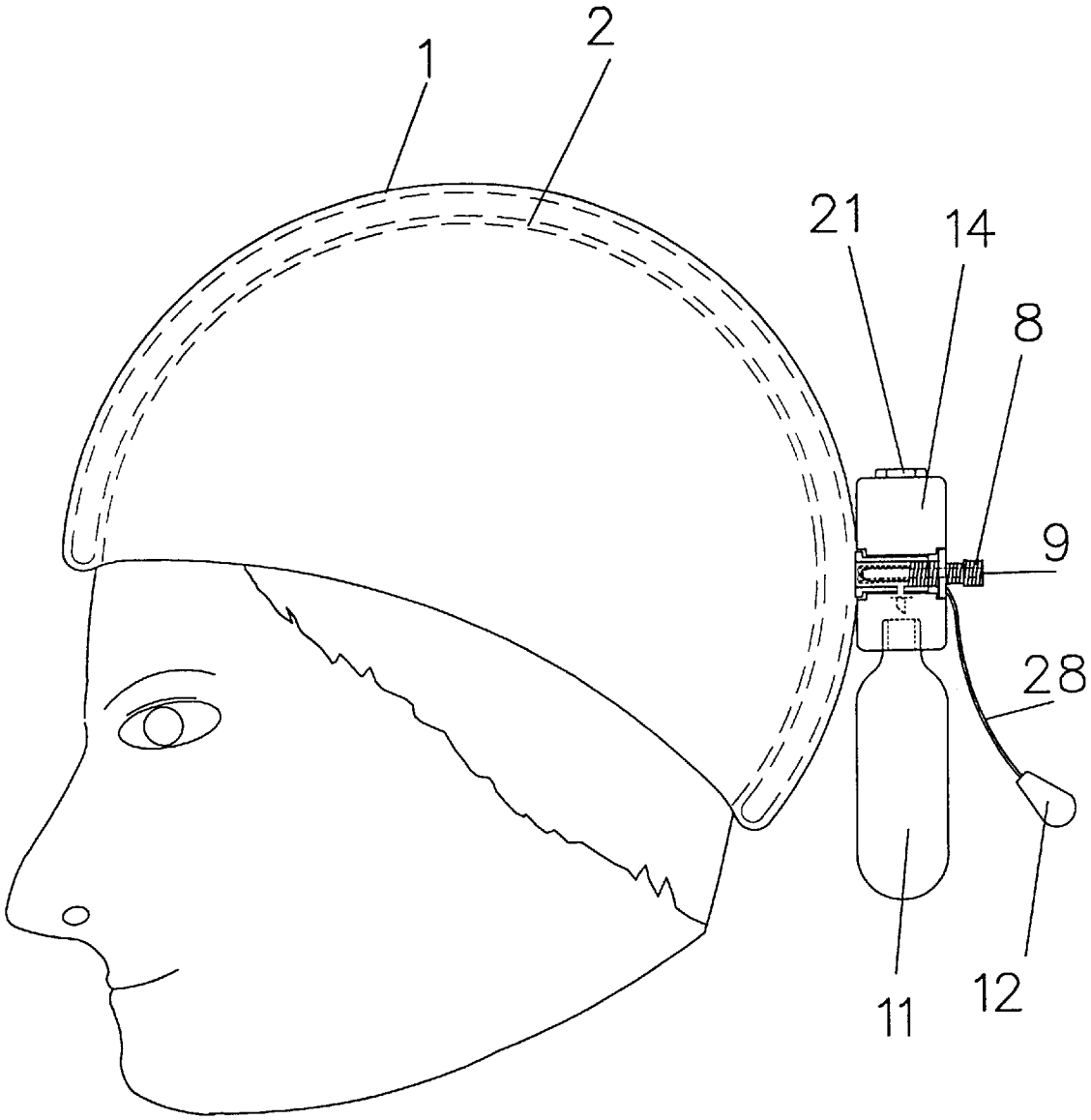
FIG. 2 shows the buoyancy aid being worn as a swimming cap and with the inflation unit including its triggering mechanism readily available to a wearer for actuation, FIG. 2 showing how one part of the general unshelled peanut form with its waisted region (see FIG. 1) is configured such that one part (ie; on one side of the waisted region) is inside, the other part which is outside being the other side of the waisted region.

In FIG. 1 it can be seen that the inflatable envelope or cap defining means is configured in its deflated condition as shown to have a waisted region on the axis 3 and two separate parts 1 and 2 disposed on either side thereof, that part 2 being locatable within that part 1 (at least to a substantial extent) to configure the inflatable envelope into the form depicted in FIG. 2 which is capable of being worn as a cap.

An opening 10 into the envelope enables the fitment of a triggerable inflation unit to the envelope.

The inflation unit preferably comprises a gas cylinder (for example, a $CO_2$ cylinder) engageable into a threaded opening 19 of an assembly 14.

The assembly 14 is connected by means of a sleeve 4 having a threaded bore 6, an outwardly extending flange 18 and an opening 5 in to the bore 6. The flanged end of the sleeve 4 is adapted to be inserted in to the inflatable envelope and to be retained through the opening 10.

The assembly 14 is held in place together with its gas cylinder 11 by an interaction of the threaded sleeve 4 with member 8 which locates through chamber 20 in the assembly 14 by means of its outwardly extending flange 17, the threaded region 7 engaging into the thread 6 of the sleeve 4.

Figure 3:
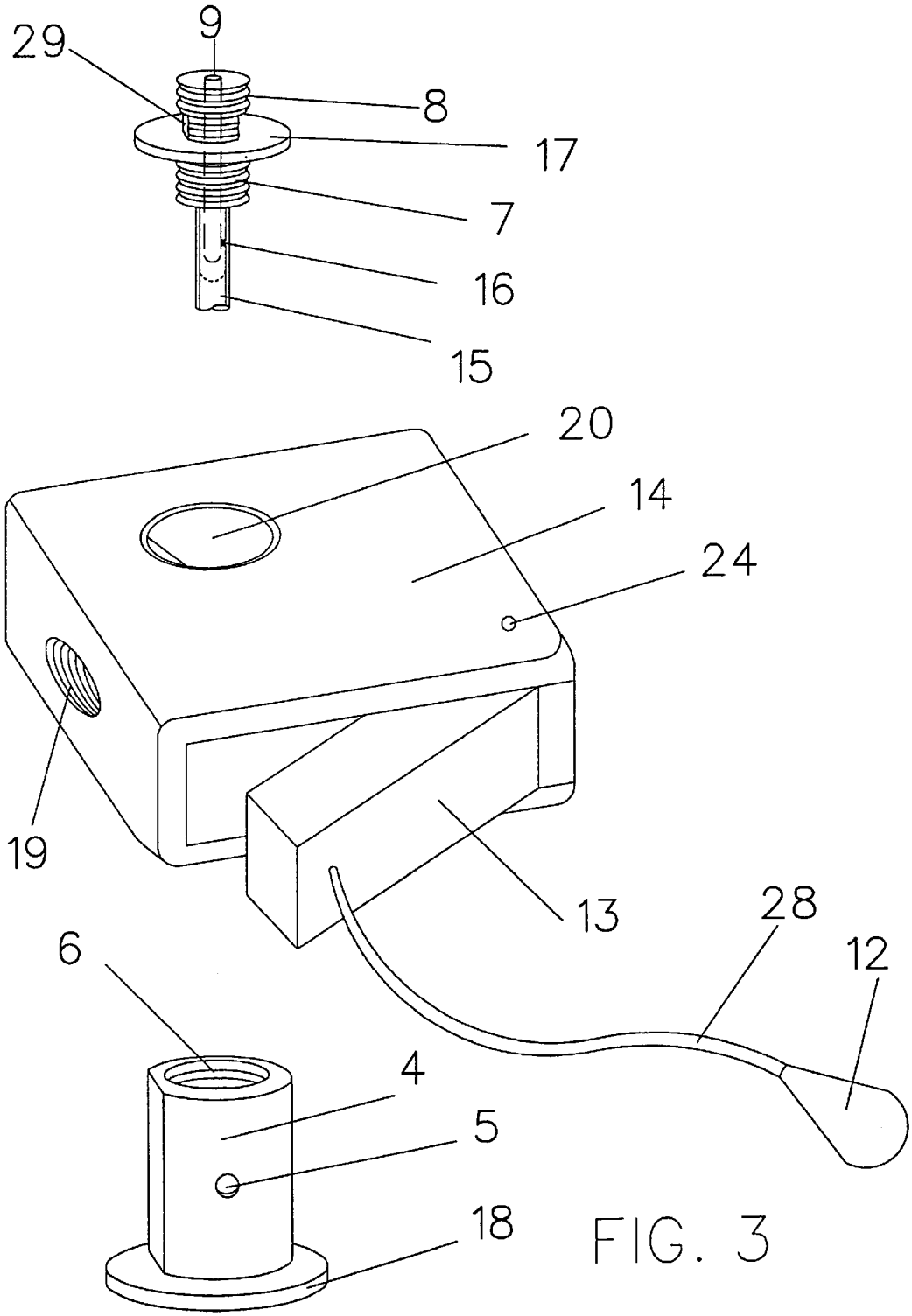
FIG. 3 shows the components of the inflation unit in perspective.

A better view of the arrangement can be seen in FIG. 3 where passageway 9 is for air from a pump through a one way valve. An elastomeric or rubber sleeve 15 renders the passageway 9 which exits via a lateral opening 16 a non return valve such that any air injected (eg; during testing) through the opening to the passageway 9 will only have the effect of inflating the device. The threaded region 8 is to facilitate engagement of the device to an air pump (for example, a cycle pump) whilst the chamfer 29 is to facilitate the engagement of the device with a mini spanner or the like to allow its tightening or removal from the threaded bore 6.

Figures 4, 5:
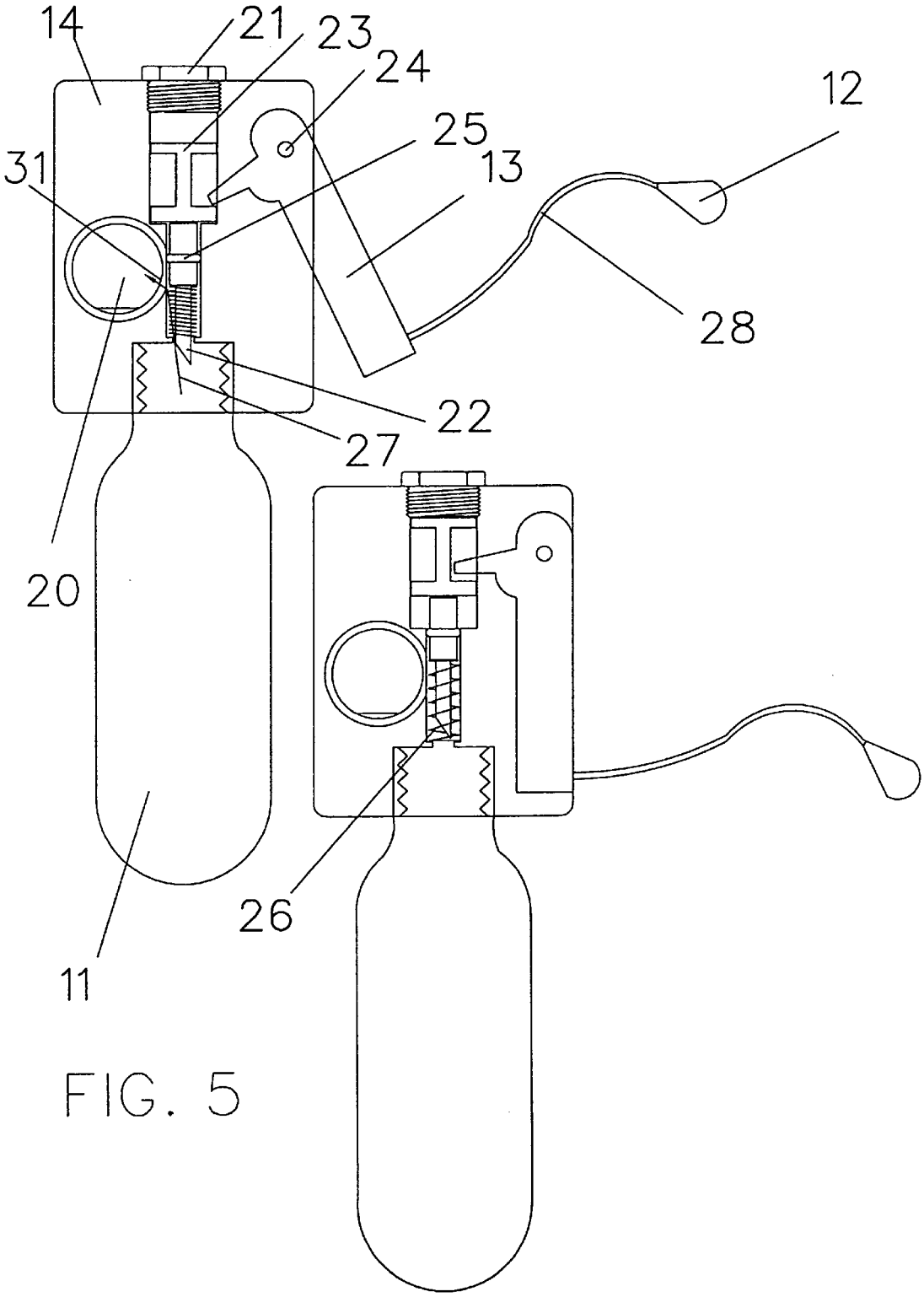
FIG. 4 shows a section of the inflation unit in its untriggered form.
FIG. 5 shows the same inflation unit of FIG. 4 but with the trigger mechanism actuated which results in a penetrating member releasing pressurised gas from a reservoir into the inflatable envelope.
Figure 6:
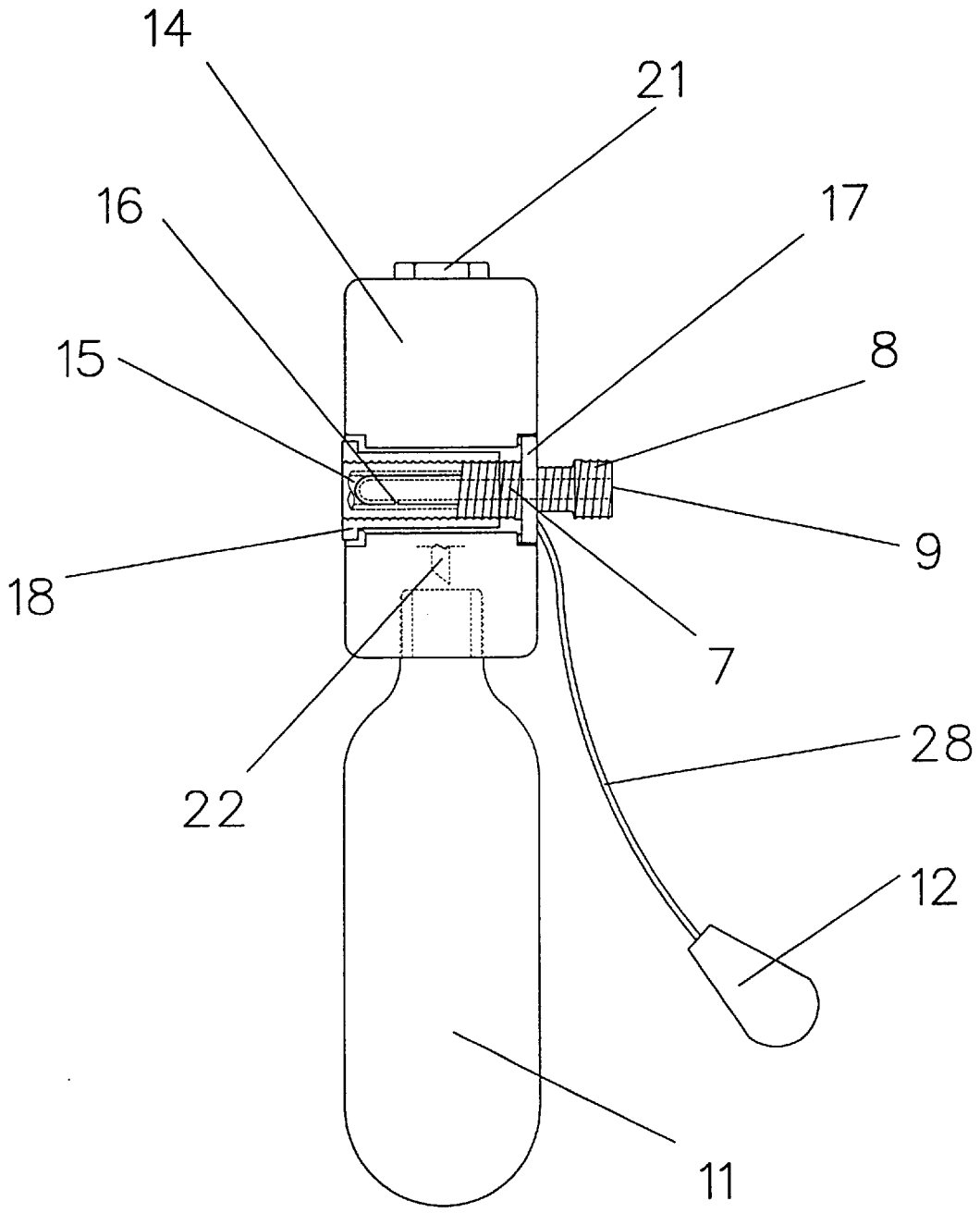
FIG. 6 shows a section of the inflation unit in the direction perpendicular to the section shown in FIG. 4.

The assembly 14 pivots a triggering member 13 on a pivot axis provided by pin 24 such that member 13 is moveable between the conditions shown in FIGS. 4 and 5 under a triggering action such as a pulling of the end 12 of a triggering cord 28.

As can be seen best in FIGS. 4 and 5 the triggering member 13 has an extension which engages in a captive manner a piston member 23 located to move against a bias provided by spring 26. A threaded closure 21 limits the piston movement whilst an annular shoulder limits the other extent of movement. This annular shoulder leads to a passageway through to the sealed top 30 of the gas reservoir or cylinder 11.

The movement of the piston 23 from its condition as shown in FIG. 4 (untriggered) to its triggered condition as shown in FIG. 5 is such as to move a penetrative member 22 against the bias of the spring 26 into the cylinder to achieve gas release. Gas released flows in the arrowed direction (27) shown in FIG. 5 into the chamber 20 of the assembly 14 such that it is prevented from loss to the atmosphere by the non return valve nature of the assembly having the resilient sleeve 15. As a consequence the inflating gas can only egress from the chamber 20 via the opening 5 to inflate the inflatable envelope or cap defining means.

The arrangement of the member carried by the piston 23 is such that a seal 25 (for example, an "O" ring) is provided to ensure the flow path 27 into the chamber 20 results from the penetration by the member 22 of the seal or closure 30 of the gas cylinder 11. To assist the flow a groove, if desired, can be provided in at least the distal regions of the member 22 to allow gas egress after penetration.

Figure 8:
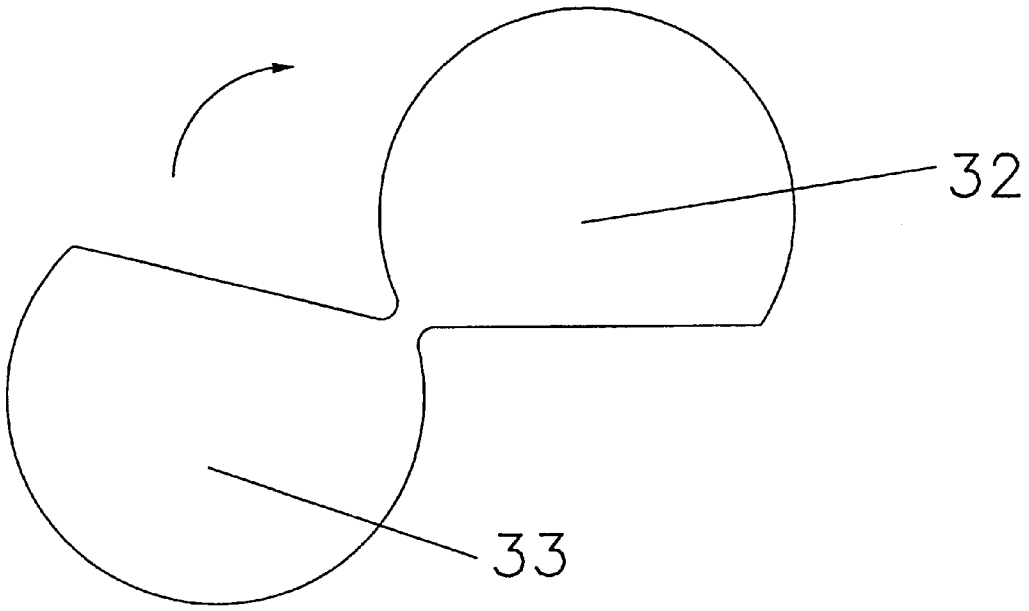
FIG. 8 shows a different embodiment to that elsewhere shown, this embodiment being a cap adapted to hinge with one part or lobe dependent from another, each part or lobe (there can in fact be more than just the two lobes referred to) preferably each itself defining (with a double wall) an inflatable envelope which preferably, for ease of inflation, is communicable from one to another such that a single inflation allowing means might be used (although this is not mandatory)
Figure 9:
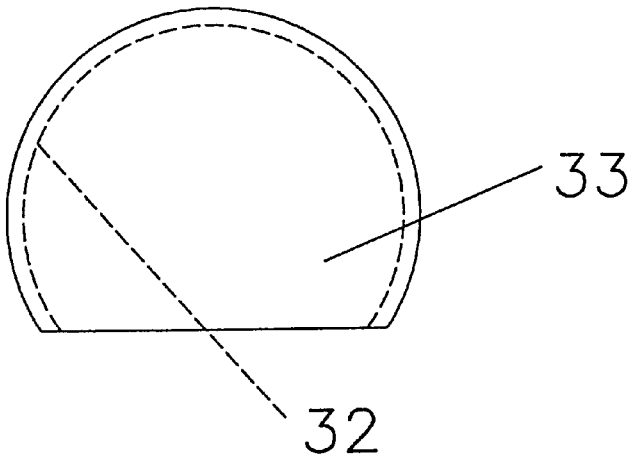
FIG. 9 shows the arrangement of FIG. 9 with part of the double wall cap defining means of FIG. 8 still received within another part, itself a double walled envelope.

Other forms of the swimming cap can differ from that disclosed in FIG. 1. For example FIG. 8 shows a first lobe 33, itself a double walled envelope in a cap defining form, from which is hinged (by an appropriate air leakage conduit) a similar double walled cap defining envelope or lobe which can overlie the other 32 (ie, to have part receivable within the other part) as shown in FIG. 9. Other multilobe forms fall within the scope of the present invention whether or not all are themselves immediately inflated or are trickle inflated upon actuation of the inflation unit or the means to allow inflation. Constructions are envisaged whereby there might be separately provided buoyant chambers capable of one way valve breath inflation to add to that measure of buoyancy that can be provided with the immediacy of gas release from a pressure reservoir. All such embodiments fall within the scope of the present invention.

Preferred materials from which the cap defining member is formed includes a natural rubber or a synthetic rubber. Indeed a variety of different materials may be used, including for example, a suitable polyester rather than a latex or silicone rubber.

The device, if desired, during its manufacture and assembly can be tested by inflation without a need to release the contents of a gas cylinder 11. For this purpose pumping via the inlet 9 may be utilised. Air pumped along air duct 9 produces a higher pressure inside the duct, duct 15 expands, allowing air to pass through hole 16 and inflate the envelope. Elastic duct 15 prevents the air inside the envelope from flowing in the reverse direction, allowing for the pump to be removed. The inflated envelope can then be tested for leakage by immersion in water. The inflatable envelope can thereafter be readily deflated by a small degree of disassembly (eg; removal of a gas cylinder 11) and then reassembly of the inflation unit prior to sale. The product may be offered for sale with or without gas cylinders.

Whilst a preferred inflation unit as depicted herein is preferably utilised, other inflation units may instead be utilised. It is most desirable however that any such device is not likely to be accidentally triggered and is small so as not to interfere with the normal swimming function whilst the buoyancy aid is being worn in its uninflated cap defining form.

It is desirable that in order to achieve full inflation that it is not necessary to hold the triggering device whilst inflation occurs. It is desirable therefore that there be some balance provided as to the quantity of gas and its pressure that is available from the reservoir 11 so as not to burst the inflatable envelope.

It is believed that a buoyancy aid in accordance with the present invention provides a swimming cap acceptable for many potential swimmers which not only does not interfere with the joy of swimming but which can, upon a simple actuation of the trigger device, provide a more than adequate buoyancy aid capable of being easily gripped to support the swimmer if in difficulty.

What is claimed is:

1. A buoyancy aid wearable as a swimming cap in its uninflated condition and usable as a buoyancy aid in an inflated condition, said buoyancy aid comprising a cap defining means configurable in its to be worn condition to have one part thereof within another part thereof, said cap defining means including at least one inflatable chamber, and an inflation unit carried by said cap defining means and activatable to inflate said inflatable chamber, said inflation unit including a body portion, a body chamber in said body portion communicating with said at least one inflatable chamber;

a reservoir carried by said body portion and capable of releasing an inflating gas; and a triggering member carried by said body portion and readily activatable to release at least some of said inflating gas from said reservoir, wherein, when said triggering member is activated to release said at least some of said inflating gas from said reservoir, said at least some of inflating gas is ducted into and through said body chamber and into said at least one inflatable chamber such that upon actuation of the inflation unit, the inflatable chamber configures said cap defining means to a form no longer wearable as a cap and with said one part no longer within said another part.

2. A buoyancy aid as claimed in claim 1 wherein said cap defining means when in its fully inflated form has a configuration that is substantially that of an unshelled peanut having a waisted region at or near its mid section and said one part is that part of such substantial unshelled peanut form on one side of said waisted region thereof and said other part thereof is the part on the other side of said waisted region thereof.

3. A buoyancy aid as claimed in claim 1 wherein said inflation unit further includes a one-way valve mechanism carried by said body portion.

4. A buoyancy aid as claimed in claim 3 wherein said body portion conducts an inflating gas into said inflatable chamber from an external gas supply via said one-way valve mechanism.

5. A buoyancy aid as claimed in claim 4 wherein said inflation unit is actuable by a manual activation of a triggering mechanism.

6. A buoyancy aid as claimed in claim 1 wherein said cap defining means is of a resilient material selected from the group consisting of rubber and elastomer.

7. A buoyancy aid as claimed in claim 1, wherein said inflation unit further includes a piston moveable by the manipulation of said triggering member between an unactivated and an activated position; and a penetrative member connected to said piston so as to move in conjunction with said piston such that, when said triggering member is manipulated so as to move said piston to said activated position, said penetrative member enters said reservoir and thereby causes the release of said inflating gas.

8. The buoyancy aid as claimed in claim 7 wherein said piston is biased in said unactivated position and the manipulation of said triggering member serves to move said piston from said unactivated position to said activated position.

9. The buoyancy aid as claimed in claim 7 wherein said inflating gas, once released from said reservoir, is channeled into said body chamber such that said inflating gas can only egress from said body chamber to said at least one inflatable chamber.

10. A buoyancy aid wearable as a swimming cap in its uninflated condition and usable as a deployable buoyancy aid in an inflated condition, said buoyancy aid comprising an inflatable member including at least one inlet, said inflatable member having at least one inlet, said inflatable member being configurable when uninflated to define a swimming cap with one part of the member to be interposed between a wearer's head and another part of the member, and an inflation unit carried by said inflatable member in both its uninflated and inflated forms and activatable to inflate said inflatable member to provide a float no longer wearable as a swimming cap, said inflation unit comprising:

a body having a capability of ducting an inflating gas into said inflatable member via said at last one inlet;

a reservoir carried by said body to provide an inflating gas;

an inflation control mechanism carried by said body readily activatable to release at least some of the content of said reservoir via said body and said at least one inlet so as to conform said inflatable member to an inflated buoyancy float form; and a one-way valving mechanism carried by said body, wherein said body can duct an inflating gas into said inflatable member either from an external gas supply via said one-way valve or direct from said reservoir, and wherein said reservoir may be disengaged from said body thereby allowing deflation of said inflatable member via said at least one inlet.

11. A buoyancy aid as claimed in claim 10 wherein said inflation unit further includes a piston moveable by the manipulation of said triggering member between an unactivated and an activated position;

a penetrative member connected to said piston so as to move in conjunction with said piston such that, when said triggering member is manipulated so as to move said piston to said activated position, said penetrative member enters said reservoir and thereby causes the release of said inflating gas.

12. A buoyancy aid as claimed in claim 11 wherein said piston is biased in the unactivated position such that manipulation of said triggering member serves to move said piston from said unactivated position to said activated position.

13. A buoyancy aid as claimed in claim 12 wherein said inflating gas, once released from said reservoir, is channeled into said body chamber such that said inflating gas can only egress from said body chamber to said at least one inflatable chamber.

14. A buoyancy aid as claimed in claim 10 wherein said inflatable member when in its fully inflated form has a configuration that is substantially that of an unshelled peanut having a waisted region at or near its mid point and one part of such substantial unshelled peanut form on one side of said waisted region thereof in the uninflated condition is insertable in the part on said other side of the waisted region thereof.

15. A buoyancy aid as claimed in claim 10 wherein said inflatable member is of a resilient material selected from the group consisting of rubber and elastomer.

* * * * *